United States Patent [19]

Wawryk

[11] Patent Number: 4,889,345

[45] Date of Patent: Dec. 26, 1989

[54] BOARD GAME

[76] Inventor: Randy A. Wawryk, 215 Amherst Street, Winnipeg, Manitoba R3J 1Y5, Canada

[21] Appl. No.: 230,360

[22] Filed: Aug. 10, 1988

[51] Int. Cl.[4] ..... A63F 3/00

[52] U.S. Cl. ..... 273/249; 273/290

[58] Field of Search ..... 273/243, 249, 256, 290, 273/236

[56] References Cited

U.S. PATENT DOCUMENTS

| | | | |
|---|---|---|---|
| 621,799 | 3/1899 | Degges | 273/290 |
| 2,333,702 | 11/1943 | Coghlan et al. | 273/273 |
| 3,394,471 | 7/1968 | Holten | 273/273 |
| 3,841,628 | 10/1974 | Goldfarb | 273/273 |
| 3,892,409 | 7/1975 | Herbert | 273/273 |
| 4,109,918 | 8/1978 | Mele et al. | 273/256 |
| 4,315,627 | 2/1982 | Schlegel et al. | 273/249 |
| 4,378,941 | 4/1983 | Derby | 273/273 |
| 4,522,407 | 6/1985 | Hatherley | 273/256 |
| 4,736,954 | 4/1988 | Haney et al. | 273/236 |

*Primary Examiner*—Edward M. Coven
*Assistant Examiner*—Benjamin Layno
*Attorney, Agent, or Firm*—Jerry T. Kearns

[57] ABSTRACT

A board type game utilizes a square game board having an outer perimeter track and an adjacent inner track, each formed by a series of adjacent squares. A square central portion of the game board is designated by five consecutively numbered circles. The four corner squares on the outer track are designated as starting squares and the remaining squares of the outer track are designated by repeated series of numbers one through five. Some of the squares in the outer track are designated as penalty squares. The squares of the inner track are designated similarly as the outer track, with the exception that the corner squares are designated as penalty squares. The game utilizes question and answer cards which are divided into five different categories. Each card is printed with the last name of a famous individual and a clue as to the individual's identity. The answer, which is the individual's first name, is also printed on the card. In the play of the game, each player moves a playing token about the outer and inner tracks to the central portion of the game board according to the throw of dice and the correct answering of the various question cards.

1 Claim, 3 Drawing Sheets

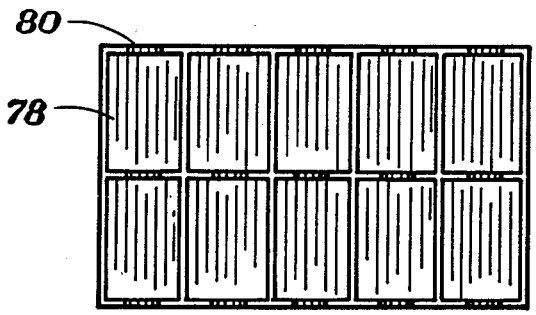
Fig 5
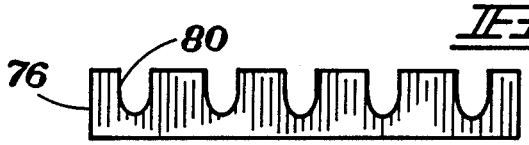
Fig 6
Fig 7
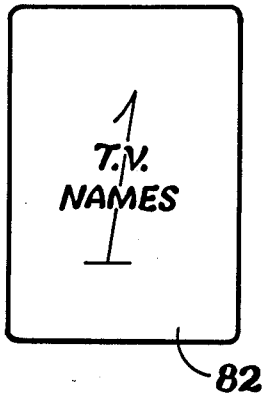
Fig 8
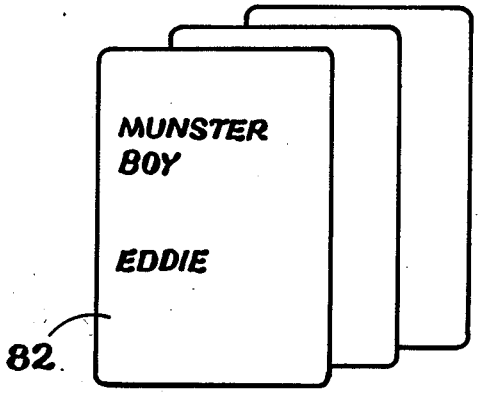
Fig 9
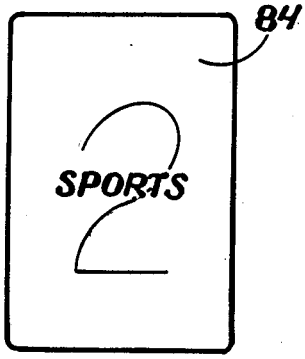
Fig 10
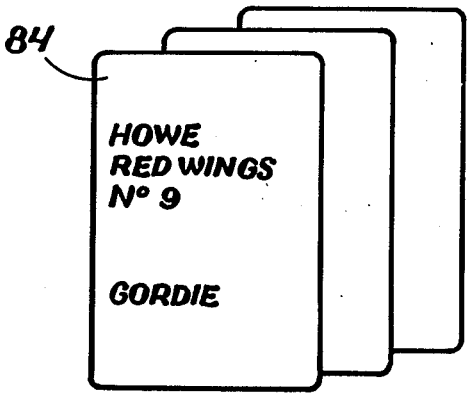

BOARD GAME

BACKGROUND OF THE INVENTION

1. Field of the Invention

The present invention relates to board games, and more particularly pertains to a new and improved board game which is played in a competitive race track game board format and is dependent upon the player's knowledge of the first names of various famous individuals.

2. Description of the Prior Art

Various types of board games are known in the prior art. A typical example of such a board game is to be found in U.S. Pat. No. 2,333,702, which issued to V. Coghlan et al on Nov. 9, 1943. This patent discloses a game board which utilizes a board designated with the representation of a leopard without the characteristic spots thereof. A plurality of playing pieces in the form of discs and of a color on one side to represent leopard spots and having legends on opposite sides thereof adapted to be placed on the representation of the leopard with either side uppermost are placed on the game board according to the random drawing of cards. U.S. Pat. No. 3,394,471, which issued to J. Holten on July 30, 1968, discloses an educational board game for teaching a language by matching a word on a card in one language with an area on a game board having the word thereon in another language. U.S. Pat. No. 3,841,628, which issued to A. Goldfarb on Oct. 15, 1974, discloses a game which utilizes a board having a plurality of different indicia and utilizing indicating cards bearing the same indicia as appear on the board for randomly indicating the indicia on the board and a plurality of striking members comprising suction cups for striking an indicia on the game board. U.S. Pat. No. 3,892,409, which issued to C. Herbert on July 1, 1975, discloses a game board divided into a plurality of squares with each square bearing a symbolic representation of a particular article. Various image bearing tiles are placed on the squares of the game board with the objective being to form horizontal or vertical rows of tiles, with each row corresponding to a particular named category. U.S. Pat. No. 4,378,941, which issued to P. Derby on Apr. 5, 1983, discloses an educational board game for teaching bird watching skills. The game includes a four sided playing board having a continuous path around the perimeter, the path being partitioned into recessed spaces for the reception of various tiles. The game utilizes a plurality of playing cards depicting birds and a second set of mystery bird cards providing clues to bird identification. The object of the game is for each player to correctly match the birds with their habitats or to identify them by use of written clues. The play of the game is dictated according to the throw of dice.

While the above mentioned devices are suited for their intended usage, none of these board games utilize a game board with inner and outer perimeter paths in conjunction with cards bearing questions and answers indicating the first names of various famous individuals. Inasmuch as the art is relatively crowded with respect to these various types of board games, it can be appreciated that there is a continuing need for and interest in improvements to such board games, and in this respect, the present invention addresses this need and interest.

SUMMARY OF THE INVENTION

In view of the foregoing disadvantages inherent in the known types of board games now present in the prior art, the present invention provides an improved board game. As such, the general purpose of the present invention, which will be described subsequently in greater detail, is to provide a new and improved board game which has all the advantages of the prior art board games and none of the disadvantages.

To attain this, a representative embodiment of the concepts of the present invention is illustrated in the drawings and make use of a square game board having an outer perimeter track and an adjacent inner track, each formed by a series of adjacent squares. A square central portion of the game board is designated by five consecutively numbered circles. The four corner squares on the outer track are designated as starting squares and the remaining squares of the outer track are designated by repeated series of numbers one through five. Some of the squares in the outer track are designated as penalty squares. The squares of the inner track are designated similarly as the outer track, with the exception that the corner squares are designated as penalty squares. The game utilizes question and answer cards which are divided into five different categories. Each card is printed with the last name of a famous individual and a clue as to the individual's identity. The answer, which is the individual's first name, is also printed on the card. In the play of the game, each player moves a playing token about the outer and inner tracks to the central portion of the game board according to the throw of dice and the correct answering of the various question cards.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game which has all the advantages of the prior art board games and none of the disadvantages.

It is another object of the present invention to provide a new and improved board game which may be easily and efficiently manufactured and marketed.

It is a further object of the present invention to provide a new and improved board game which is of a durable and reliable construction.

An even further object of the present invention is to provide a new and improved board game which is susceptible of a low cost of manufacture with regard to both materials and labor, and which accordingly is then susceptible of low prices of sale to the consuming public, thereby making such board games economically available to the buying public.

Still yet another object of the present invention is to provide a new and improved board game which provides in the apparatuses and methods of the prior art some of the advantages thereof, while simultaneously overcoming some of the disadvantages normally associated therewith.

Still another object of the present invention is to provide a new and improved board game which utilizes a game board having inner and outer tracks designated by a series of numbers corresponding to various categories of question cards.

Yet another object of the present invention is to provide a new and improved board game which tests a player's knowledge of the first names of various famous individuals.

Even still another object of the present invention is to provide a new and improved board game which utilizes a race track board game format in conjunction with a plurality of question category cards to provide a fast paced and amusing game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a plan view illustrating a question category card holder utilized in the game of the present invention FIG. 6 is a side view of the card holder of FIG. 5.

FIG. 7 illustrates the back face of a first category of question card.

FIG. 8 provides a representative illustration of the opposite face of the card of FIG. 7.

FIG. 9 illustrates the back face of a second category question card.

FIG. 10 provides a representative illustration of the front face of the card of FIG. 9.

DESCRIPTION OF THE PREFERRED EMBODIMENT

Figure 1:
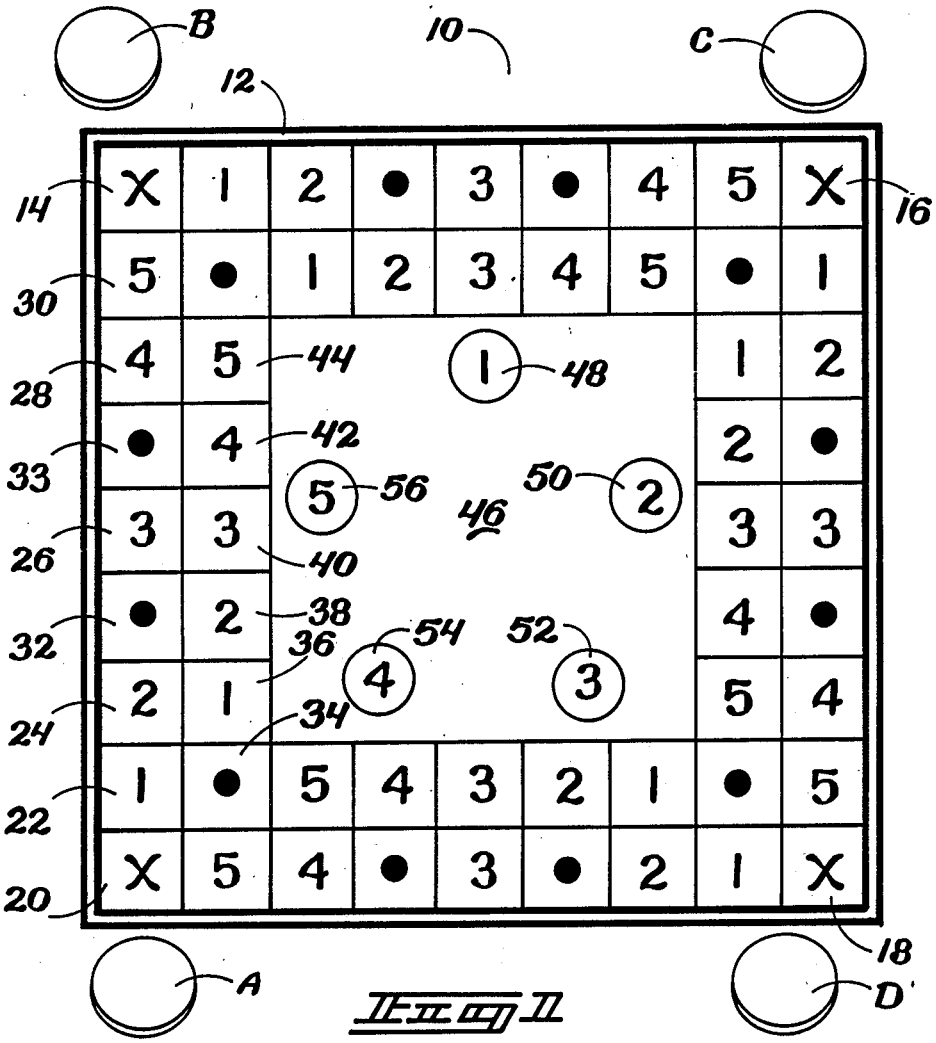
FIG. 1 is a plan view of the game board utilized in the game of the present invention.

With reference now to the drawings, and in particular to FIG. 1 thereof, a new and improved board game embodying the principles and concepts of the present invention and generally designated by the reference numeral 10 will be described.

More specifically, it will be noted that the first embodiment 10 of the invention includes a generally square game board 12. An outer perimeter track is formed on the game board 12 by a series of adjacent squares. The corner squares 14, 16, 18 and 20 of the outer perimeter track are each designated by the symbol "X". Each side of the outer perimeter track has five squares 22, 24, 26, 28 and 30 which are sequentially numbered from one through five. Two of the squares 32 and 33 on each side of the outer perimeter track are designated by a black dot symbol. An inner track is formed within the outer perimeter track and adjacent thereto by a plurality of sequential squares. Each of the corner squares 34 of the inner track are designated by a black dot symbol. The remaining squares at each side of the inner perimeter track 36, 38, 40, 42 and 44 are sequentially numbered from one through five. A square central zone 46 is bordered by the inner track and is provided with five circles which are evenly spaced about the central point of the game board 12. The circles 48, 50, 52, 54 and 56 are sequentially numbered from one through five. Four different colored game markers A, B, C and D are utilized for movement about the game board 12 in the play of the game of the present invention.

Figure 2:
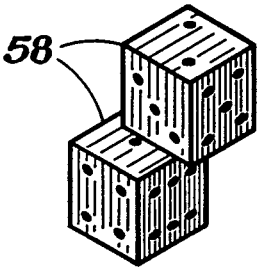
FIG. 2 is a perspective view illustrating a pair of dice utilized in the play of the game of the present invention.

FIG. 2 illustrates a conventional pair of dice 58 utilized in the game of the present invention.

Figure 3:
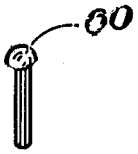
FIG. 3 is a front view of a score keeping flag or peg utilized in the play of the game f the present invention.

FIG. 3 illustrates a score keeping flag or peg 60 utilized in keeping score in the game of the present invention.

Figure 4:
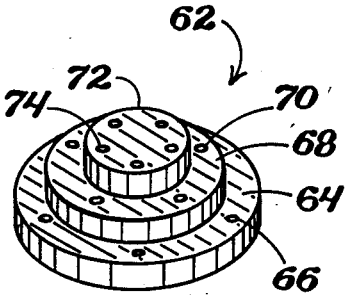
FIG. 4 is a perspective view illustrating a score keeping flag or peg holder utilized in the play of the game of the present invention.
Figure 11:
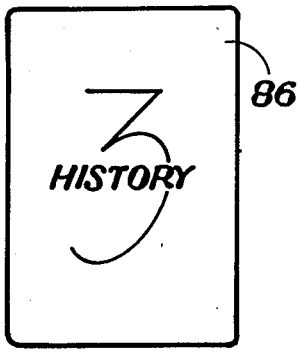
FIG. 11 illustrates the back face of a third category question card.
Figure 12:
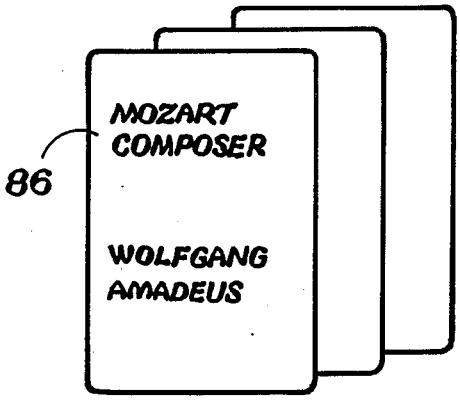
FIG. 12 provides a representative illustration of the front face of the card of FIG. 11.
Figure 13:
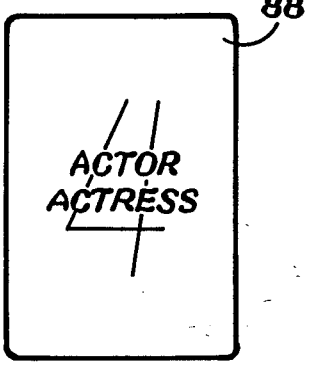
FIG. 13 illustrates the back face of a fourth question card.

FIG. 4 illustrates a three tiered score marker 62. The lower or first tier 64 is provided with a plurality of spaced apertures 66 for the insertion of the score keeping pegs 60. The second tier 68 is provided with a plurality of similar apertures 70 and the third tier 72 is provided with a plurality of apertures 74.

FIG. 5 illustrates a plan view of a compartmentalized card storage tray which may be utilized in the game of the present invention. The storage tray 76 has a plurality of individual compartment 78 which are provided with finger access slots 80.

FIG. 6 provides a side view of the card storage tray 76.

FIG. 7 illustrates the back face of one of a first group of subject category question cards 82. The back face of each card in this category is designated by the numeral one and is printed with "T.V. NAMES".

FIG. 8 illustrates a representative example of the back face of one question card in category 1. The card is printed with the last name of a famous individual in the subject category, here for example "Munster" and is also printed with a clue to the individual's identity. Here the clue is "boy". Additionally, the answer, which in all cases is the individual's first name, is also printed on the front face of each card. Here, for example, the first name of the individual is "Eddie".

FIGS. 9 through 16 illustrate the remaining subject question categories 2 through 5 and provide a representative illustration of an individual card in each category.

Prior to play of the game of the present invention, the five different groups of subject category question cards are shuffled and are each placed in one of the compartments of the card storage tray 76 (FIG. 5). The card storage tray 76 is provided with ten different compartments 78. It is contemplated that two different difficulty levels of each of the subject categories may be provided. Thus, a first level of least difficult questions are printed on the first level of subject category question cards of groups 1 through 5. A second group of subject category cards 1 through 5 bears additional, more difficult questions. After the different groups of cards are separated and arranged in the card storage tray 76, the play of the game may be commenced.

Figure 14:
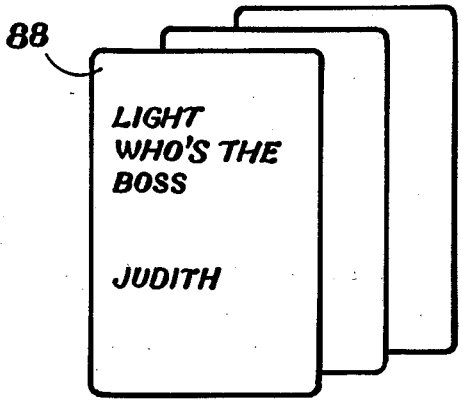
FIG. 14 provides a representative illustration of the front face of the card of FIG. 13.
Figure 15:
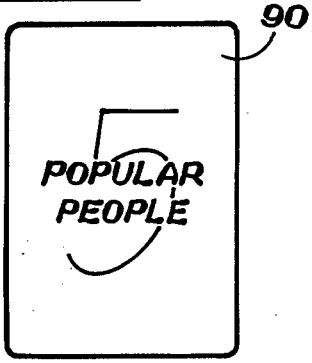
FIG. 15 illustrates a fifth category question card.
Figure 16:
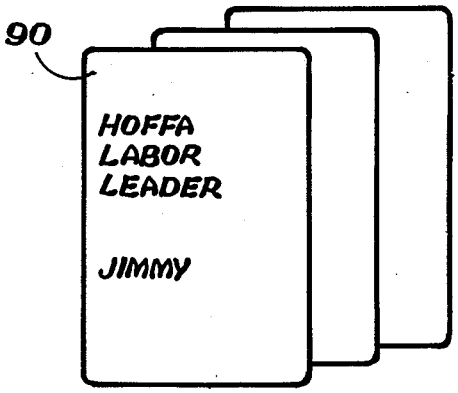
FIG. 16 provides a representative illustration of the front face of the card of FIG. 15.

With reference now to FIG. 1, the manner of play will now be described. Initially, each of four players or the designated representatives of four groups of players place one of the game markers A, B, C, D on one of the corner starting squares 14, 16, 18 or 20. The player selected to go first then rolls the dice 58 (FIG. 2) and moves the game marker the number of spaces determined by the throw of the dice. If the game marker lands on the "X" symbol or one of the black dot symbols, the player is ineligible to answer any questions and must remain until the next turn. If the player lands on one of the squares numbered 1 through 5, one of the adjacent players draws the top card from the corresponding subject category and asks the player the question. For example, if player A initially lands on square 28, player B will draw the top card in category 4 (FIG. 13) and will then ask the question on the front face of the card 88 (FIG. 14). Player B reads the last name of the famous individual, "Light" and also reads the clue, "Who's the Boss". Player A then attempts to give the first name of the individual. If player A correctly answers "Judith" then the player receives a peg 60 which is then inserted into the player's score marker 62 (FIG. 4). Play continues in this fashion with the dice being passed in a clockwise direction about the game board 12. As each player correctly answers a question, each player receives a peg 60 for insertion into the first tier 64 of their score markers 62. When any player correctly answers a sufficient predetermined number of questions and thus fills all the apertures 66 on the first tier 64 of their score marker 62, the player may move their game marker to the inner track. Any player moving their token on the inner track is asked a question from the second, more difficult level of question cards in each category. When a player moving their token on the inner track has answered a predetermined number of questions correctly, sufficient to fill the apertures 70 on the second tier 68 of their score marker 62 with pegs 60, the player moves their token to one of the numbered circles, 48; 50, 52, 54 or 56 in the central zone 46 of the game board 12. It is contemplated that only one die 58 will be rolled by a player once they have reached the inner track. Upon reaching the third level corresponding to the central zone 46, the player need not roll any dice, but may choose any subject category to answer. The player then moves their game marker to the correspondingly numbered circle. Only one player may occupy a particular numbered circle at a time. Thus, the player who reaches the numbered circle 48 first has a monopoly on that subject category until he elects to move to a different circle. The winner of the game is the first player to answer a sufficient number of questions correctly to fill all of the apertures 74 on the top tier 72 of their score marker 62 with score pegs 60.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A board game, comprising:
- a generally square game board;
- an outer perimeter track formed by a series of adjacent squares around said game board;
- an inner track formed by a series of adjacent squares within said outer perimeter track;
- four corner squares of said outer perimeter track each designated by an "X" symbol;
- two spaced squares on each of the four sides of said outer perimeter track designated by a dot;
- remaining squares of said outer perimeter track designated by repeating sequential series of the numbers one through five;
- four corner squares of said inner track designated by a dot;
- remaining squares of said inner track designated by repeating sequential series of the numbers one through five;
- a square central zone bordered by said inner track;
- five circles sequentially numbered one through five spaced evenly around a central point of said central zone;
- four different colored markers for movement around said game board;
- five different groups of subject category question cards;
- each of said question cards having a back face designated by a particular subject category and one number from one through five, and a front face bearing a name of a famous individual in said particular subject category and a clue to the individual's identity;

a pair of dice for randomly controlling movement of said markers around said game board;

four three tiered score markers, each having a color matching one of said game markers, each tier of said score markers having a plurality of spaced apertures; and a plurality of pegs for insertion into said score marker apertures.

* * * * *